US009196393B2

(12) United States Patent
Abe et al.

(10) Patent No.: US 9,196,393 B2
(45) Date of Patent: Nov. 24, 2015

(54) FOAMED RESIN MOLDED PRODUCT, FOAMED INSULATED WIRE, CABLE AND METHOD OF MANUFACTURING FOAMED RESIN MOLDED PRODUCT

(71) Applicant: Hitachi Cable, Ltd., Tokyo (JP)

(72) Inventors: Masahiro Abe, Hitachi (JP); Masafumi Nagano, Hitachi (JP); Akinari Nakayama, Hitachinaka (JP)

(73) Assignee: HITACHI METALS, LTD., Tokyo (JP)

( * ) Notice: Subject to any disclaimer, the term of this patent is extended or adjusted under 35 U.S.C. 154(b) by 217 days.

(21) Appl. No.: 13/844,895

(22) Filed: Mar. 16, 2013

(65) Prior Publication Data

US 2014/0069686 A1 Mar. 13, 2014

(30) Foreign Application Priority Data

Sep. 13, 2012 (JP) ..... 2012-201239

(51) Int. Cl.
*H01B 7/02* (2006.01)
*H01B 3/44* (2006.01)

(52) U.S. Cl.
CPC ..... *H01B 7/02* (2013.01); *H01B 3/445* (2013.01); *H01B 7/0275* (2013.01)

(58) Field of Classification Search
CPC ..... H01B 7/02; H01B 3/445; H01B 7/0275
USPC ..... 174/110
See application file for complete search history.

(56) References Cited

U.S. PATENT DOCUMENTS

| | | | | |
|---|---|---|---|---|
| 2003/0062190 | A1* | 4/2003 | Kim et al. | 174/149 R |
| 2004/0109650 | A1* | 6/2004 | Kim et al. | 385/100 |
| 2006/0293459 | A1* | 12/2006 | Yoshimoto et al. | 525/199 |
| 2008/0105449 | A1* | 5/2008 | Kenny et al. | 174/34 |
| 2011/0192632 | A1* | 8/2011 | Abe et al. | 174/120 SR |
| 2011/0198106 | A1* | 8/2011 | Sasamura et al. | 174/110 SR |

FOREIGN PATENT DOCUMENTS

| | | | |
|---|---|---|---|
| JP | S55-066934 | A | 5/1980 |
| JP | 2-34735 (B) | | 9/1990 |
| JP | 10-007833 | A | 1/1998 |
| JP | 2007-238829 | A | 9/2007 |
| JP | 2011-076860 | A | 4/2011 |
| JP | 4879613 | B2 | 2/2012 |

OTHER PUBLICATIONS

Japanese Office Action dated Jul. 7, 2015 with English translation.

* cited by examiner

*Primary Examiner* — William H Mayo, III
*Assistant Examiner* — Krystal Robinson
(74) *Attorney, Agent, or Firm* — McGinn IP Law Group, PLLC

(57) ABSTRACT

A foamed resin molded product includes not less than two fluorine resins that have a different melting point from each other. One of the not less than two fluorine resins comprises a fluorine resin that has a melting point of not more than 230 degrees C. An other of the not less than two fluorine resins comprises a fluorine resin that has a melting point of not less than 40 degrees C. higher than the fluorine resin having the melting point of not more than 230 degrees C.

18 Claims, 7 Drawing Sheets

FOAMED RESIN MOLDED PRODUCT, FOAMED INSULATED WIRE, CABLE AND METHOD OF MANUFACTURING FOAMED RESIN MOLDED PRODUCT

The present application is based on Japanese patent application No. 2012-201239 filed on Sep. 13, 2012, the entire contents of which are incorporated herein by reference.

BACKGROUND OF THE INVENTION

1. Field of the Invention

This invention relates to a foamed resin molded product, a foamed insulated wire, a cable and a method of manufacturing a foamed resin molded product.

2. Description of the Related Art

A wire using a fluorine resin for an insulator (so-called fluorine resin wire) has a high melting point and excellent solder dip resistance, thus it is used for a solder connection between a cable and a terminal and/or connector. In addition, the fluorine resin wire has excellent durability to environmental degradation such as chemical resistance, thus it is used for internal wiring of an electronic device such as a computer and wiring of a high-frequency device such as a mobile phone, a measurement device. Furthermore, the fluorine resin wire has excellent heat resistance and cold resistance, thus it is used for wiring of a high temperature device, and for a lead wire in a low temperature environment.

The conventional fluorine resin wire uses, as the insulator material thereof, polytetrafluoroethylene (PTFE), a tetrafluoroethylene-perfluoroalkyl vinyl ether copolymer (PFA) or a tetrafluoroethylene-hexafluoropropylene copolymer (FEP). These fluorine resins are excellent in heat resistance, cold resistance, and chemical resistance, and also the resins have an extremely low relative dielectric constant as 2.0 to 2.1.

However, recently, in accordance with speeding up (transmission speed: not less than 10 Gbps/sec) of an electronic device and higher frequency (GHz band frequency) of a communication device, a need that the dielectric constant is further lowered occurs. Consequently, the lowering of dielectric constant is carried out by fibrillating a fluorine resin composition by means of foaming or stretching so as to make it porous.

Attempt to make it porous is mainly carried out in PTFE. For example, PTFE that has a tape-like shape, and a porous configuration by stretching is wound on the periphery of the inner conductor as an insulator, thereby the lowering of the dielectric constant is realized (refer to JP-B-H02-34735 (Utility Model Registration)). The PTFE tape having the porous configuration is mainly used for a small-diameter high speed transmission cable.

However, the adhesion property to the inner conductor is deteriorated, and so on, thus the characteristics are also deteriorated. In addition, the PTFE tape is wound such that many layers thereof are formed so as to increase a thickness of the insulation layer, accordingly, the production speed becomes slow and the production cost becomes high.

In addition, melt extrusion cannot be applied to PTFE, thus a method of manufacturing an insulated wire is adopted, the method having a configuration that PTFE powder is impregnated with a solvent such as solvent naphtha so as to become in paste form, and then the inner conductor is coated with the paste by using a paste extruder, after that, the solvent portion is vaporized and the PTFE is sintered in a baking furnace, thereby the insulated wire is obtained. The foamed insulator obtained by the paste extrusion is mainly used for a high frequency coaxial cable.

As a method using the paste extruder, there is a method, for example, the method having a configuration that a pore-forming agent such as dicarboxylic acid is kneaded together with the PTFE powder and the pore-forming agent is vaporized at the time of sintering so as to manufacture an foamed insulated wire (refer to JP-A-2011-76860).

However, in the foaming by using the pore-forming agent, the extent of foaming is low, and there is a problem that it cannot be used for a low-loss cable.

On the other hand, in case of PFA and FEP to which melt extrusion can be applied, a physical foaming method is used, the method having a configuration that in the middle of extrusion, an inert gas as a foaming agent such as "Freon gas" (registered trade mark), nitrogen gas, carbon dioxide gas is poured into a cylinder of the extruder, and difference in pressure at the time of discharging the materials is utilized, thereby the foaming is realized (refer to JP-B-4879613).

However, in case of using the physical foaming method, it is difficult to control the amount of gas used as a foaming agent, as a result, it is impossible to control the size of the bubbles. In a small-diameter foamed insulated wire, if the bubbles are excessively increased in size, the outer diameter variation thereof is also increased, thus the problem is caused that electrostatic capacitance and characteristic impedance are deteriorated. In addition, in a large-diameter coaxial cable, enormous bubbles (pores) are generated between the inner conductor and the foamed insulator along with an outer diameter abnormality, thus the problem is caused that Voltage Standing Wave Ratio (VSWR) of a benchmark in a longitudinal direction of the cable is deteriorated.

Furthermore, a chemical foaming method is also used, the method having a configuration that a chemical foaming agent that is foamed due to heating at the time of the melt extrusion is added to a resin compound, thereby the foamed resin is obtained. The chemical foaming agent is divided broadly into two categories of an inorganic chemical foaming agent and an organic chemical foaming agent. Major types of the inorganic chemical foaming agent include sodium bicarbonate and the like, and these compounds generate carbon dioxide that has high solubility in polymer at the time of decomposition thereof. However, as a decomposition product, a metallic salt that has high dielectric constant ($\in$) and high dielectric tangent (tan $\delta$) is produced, thus it is difficult to use these compounds for a high speed transmission cable and a high frequency cable for which the lowering of the dielectric constant is needed. Consequently, an organic chemical foaming agent is mainly used.

The organic chemical foaming agent includes, for example, a bistetrazole-based compound such as bistetrazole diammonium, bistetrazole piperazine, bistetrazole diguanidine. A method of manufacturing a foamed insulator by using the organic chemical foaming agent includes a master batch (MB) method and a full compound (FC) method. The MB method is configured to prepare a foaming agent master batch (MB) in order to enhance dispersibility of the organic chemical foaming agent by adding the chemical foaming agent to the resin such that the concentration thereof is condensed to become approximately ten times of the amount used, and dilute this by adding a base resin to the amount used so as to form a resin foamed product. On the other hand, the FC method is configured to knead the chemical foaming agent and the total amount of the resin at a stroke so as to prepare a foamable compound, and feed this to a forming machine so as to form a resin foamed product.

SUMMARY OF THE INVENTION

However, of the above-mentioned fluorine resins used for a material of the insulator, FEP has a melting point of 270 degrees C. and PFA has a melting point of 310 degrees C. On the other hand, azodicarbonamide (ADCA) that is the most common azo compound used as the chemical foaming agent has a temperature of decomposition of 200 degrees C., and a tetrazole-based chemical foaming agent having the highest temperature of decomposition has a kick-off temperature of not more than 300 degrees C. Consequently, the chemical foaming agent is decomposed by being kneaded with the fluorine resin, thus there is a problem that neither the MB method nor the FC method can be adopted for the melt extrusion of PFA or FEP.

Accordingly, it is an object of the invention to provide a foamed resin molded product that is manufactured by foaming a fluorine resin such as PFA, FEP having a high melting point by a chemical foaming method, as well as a foamed insulated wire, a cable and a method of manufacturing the foamed resin molded product.

(1) According to one embodiment of the invention, a foamed resin molded product comprises:

not less than two fluorine resins that have a different melting point from each other;

wherein one of the not less than two fluorine resins comprises a fluorine resin that has a melting point of not more than 230 degrees C., and an other of the not less than two fluorine resins comprises a fluorine resin that has a melting point of not less than 40 degrees C. higher than the fluorine resin having the melting point of not more than 230 degrees C.

(2) According to another embodiment of the invention, a foamed resin molded product obtained by mixing and foaming a master batch comprising a fluorine resin that has a melting point of not more than 230 degrees C. and a chemical foaming agent, and a base resin comprising at least one fluorine resin that has a melting point of being not less than 40 degrees C. higher than the fluorine resin having the melting point of not more than 230 degrees C. by an extrusion molding method.

In the above embodiment (1) or (2) of the invention, the following modifications and changes can be made.

(i) The fluorine resin having the melting point of not more than 230 degrees C. comprises an ethylene-tetrafluoroethylene-hexafluoropropylene copolymer (EFEP), ethylene tetrafluoroethylene, or an ethylene-tetrafluoroethylene copolymer (ETFE).

(ii) The fluorine resin having the melting point of not less than 40 degrees C. higher than the fluorine resin having the melting point of not more than 230 degrees C. comprises a tetrafluoroethylene-perfluoroalkyl vinyl ether copolymer (PFA) or a tetrafluoroethylene-hexafluoropropylene copolymer (FEP).

(iii) The chemical foaming agent comprises at least one organic chemical foaming agent selected from an azo compound, a hydrazide compound, a nitroso compound, a semicarbazide compound, a hydrazo compound, a tetrazole compound, a triazine compound, an ester compound, a hydrazone compound and a diazinon compound.

(iv) The master batch comprises a foam nucleating agent.

(v) The fluorine resin having the melting point of not more than 230 degrees C. is included 1 to 40% by mass.

(vi) The master batch comprises the chemical foaming agent of 0.1 to 3% by mass relative to the total amount of the foamed resin molded product.

(vii) The foamed resin has air bubbles of which average bubble diameter corresponding to a diameter of a circle is not more than 200 μm.

(3) According to another embodiment of the invention, a foamed insulated wire comprises:

an insulation layer comprised of the foamed resin molded product according to the above embodiment (1).

(4) According to another embodiment of the invention, a cable comprises:

the foamed insulated wire according to the above embodiment (3).

(5) According to another embodiment of the invention, a method of manufacturing a foamed resin molded product comprises:

preparing a master batch comprising a fluorine resin that has a melting point of not more than 230 degrees C. and a chemical foaming agent; and mixing and foaming the master batch and a base resin comprising at least one fluorine resin that has a melting point of not less than 40 degrees C. higher than the fluorine resin having the melting point of not more than 230 degrees C. by an extrusion molding method.

Effects of the Invention

According to one embodiment of the invention, a foamed resin molded product can be provided that is manufactured by foaming a fluorine resin such as PFA, FEP having a high melting point by a chemical foaming method, as well as a foamed insulated wire, a cable and a method of manufacturing the foamed resin molded product.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Configuration of Foamed Resin Molded Product

Figure 1:
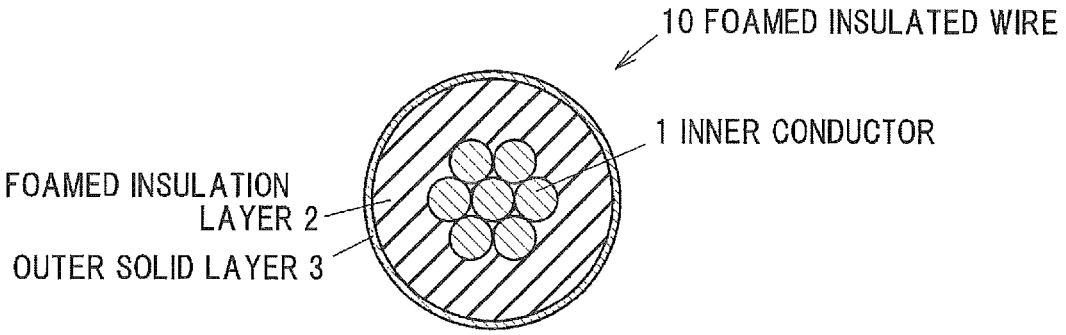
FIG. 1 is a cross-sectional view schematically showing a foamed insulated wire according to a first embodiment of the invention.

The foamed resin molded product according to the embodiment of the invention is a foamed resin molded product obtained by mixing and foaming a master batch comprising a fluorine resin that has a melting point of not more than 230 degrees C. and a chemical foaming agent and a base resin comprising not less than one fluorine resins that have a melting point of being not less than 40 degrees C. higher than the fluorine resin that has a melting point of not more than 230 degrees C. by an extrusion molding method.

Namely, the foamed resin molded product as a final form is a foamed resin molded product including not less than two fluorine resins that have a different melting point from each other, wherein one of the not less than two fluorine resins is a fluorine resin that has a melting point of not more than 230 degrees C., and the other one of the not less than two fluorine resins is a fluorine resin that has a melting point of being not less than 40 degrees C. higher than the fluorine resin that has a melting point of not more than 230 degrees C.

Master Batch

The master batch used in the embodiment of the invention includes a fluorine resin that has a melting point of not more than 230 degrees C. and a chemical foaming agent.

Fluorine Resin

The fluorine resin having a melting point of not more than 230 degrees C. used in the embodiment of the invention is not particularly limited, but it is preferred to use a fluorine resin that has a melting point lower than the temperature of decomposition of the chemical foaming agent contained in the master batch. It is more preferred to use a fluorine resin having a melting point that is not less than 10 degrees C. lower than the temperature of decomposition of the chemical foaming agent contained in the master batch. This makes it possible to knead the chemical foaming agent with the fluorine resin at a temperature lower than the temperature of decomposition of the chemical foaming agent, so that the master batch containing the chemical foaming agent can be prepared.

In particular, it is preferable that a fluorine resin having a melting point of 150 to 230 degrees C. is used, and it is more preferable that a fluorine resin having a melting point of 155 to 230 degrees C. is used. In particular, it is preferable that an ethylene-tetrafluoroethylene-hexafluoropropylene copolymer (EFEP), or an ethylene-tetrafluoroethylene copolymer (ETFE) is used. EFEP and ETFE can be used in combination. For example, EFEP having a melting point of 155 to 200 degrees C. in which the amount of modified ethylene is approximately 20 to 55%, and ETFE having a melting point of 218 to 228 degrees C. can be preferably used.

The fluorine resin having a melting point of not more than 230 degrees C. is added to the master batch such that the content thereof is preferably 1 to 40% by mass, more preferably 3 to 35% by mass, and furthermore preferably 5 to 30% by mass in the foamed resin molded product. If the content of the fluorine resin having a melting point of not more than 230 degrees C. falls within the above-mentioned range, a foamed resin molded product that has good solder dip resistance can be obtained.

Chemical Foaming Agent

It is preferable that the chemical foaming agent used in the embodiment of the invention is an organic chemical foaming agent. It is preferable that the organic chemical foaming agent is not less than one organic chemical foaming agent selected from the group consisting of an azo compound, a hydrazide compound, a nitroso compound, a semicarbazide compound, a hydrazo compound, a tetrazole compound, a triazine compound, an ester compound, a hydrazone compound and a diazinon compound. It is more preferable that the organic chemical foaming agent is not less than one organic chemical foaming agent selected from the group consisting of an azo compound, a hydrazide compound and a tetrazole compound.

It is preferred to use an azo compound, for example, having the temperature of decomposition of 208 degrees C., a hydrazide compound, for example, having the temperature of decomposition of 160 degrees C., a nitroso compound, for example, having the temperature of decomposition of 205 degrees C., a semicarbazide compound, for example, having the temperature of decomposition of 230 degrees C., a hydrazo compound, for example, having the temperature of decomposition of 220 degrees C., a tetrazole compound, for example, having the temperature of decomposition of 290 degrees C., a triazine compound, for example, having the temperature of decomposition of 270 degrees C., an ester compound, for example, having the temperature of decomposition of 250 degrees C., a hydrazone compound, for example, having the temperature of decomposition of 265 degrees C., and a diazinon compound, for example, having the temperature of decomposition of 240 degrees C.

In particular, the azo compound includes, for example, azodicarbonamide (ADCA), azobisisobutyrodinitrile (AIBN), and barium azodicarboxylate (Ba-ADC). The hydrazide compound includes, for example, 4-4'-oxybisbenzenesulfonyl hydrazide (OBSH), and p-toluenesulfonyl hydrazide. The nitroso compound includes, for example, dinitroso pentamethylene tetramine (DPT). The semicarbazide compound includes, for example, p-toluenesulfonyl semicarbazide (TSSC). The hydrazo compound includes, for example, hydrazo dicarbonamide (HDCA). The tetrazole compound includes, for example, bistetrazole diammonium, bistetrazole piperazine, bistetrazole diguanidine, 5-phenyltetrazole, azobistetrazole guanidine, azobistetrazole diaminoguanidine. The triazine compound includes, for example, trihydrazino triazine (THT). The ester compound includes, for example, hydrazo carboxylic acid ester (MC-ESTER), azodicarboxylic acid ester (ADC-ESTER), and citric acid ester. The hydrazone compound includes, for example, sulfonyl hydrazone. The diazinon compound includes, for example, 5-phenyl-3,6-dihydro-1,3,4-oxydiazine-2-one. Not less than two of these compound can be used in combination.

The chemical foaming agent is added to the master batch such that the content thereof is preferably 0.1 to 3% by mass, and more preferably 0.5 to 3% by mass in the foamed resin molded product. The additive amount of the chemical foaming agent is determined as an amount required for obtaining a desired extent of foaming dependent on an amount of gas generated at the time of decomposition of the chemical foaming agent and an amount of resin discharged from the extruder. If the content of the chemical foaming agent falls within the above-mentioned range, the decomposition residue of the chemical foaming agent has little influence, thus such a foamed resin molded product that if the foamed resin molded product is used for a wire, the wire has good electric characteristics, can be obtained. In addition, a foamed resin molded product that has small variation of an air bubble diameter can be obtained.

A preferable combination of the fluorine resin having a melting point of not more than 230 degrees C. and the chemical foaming agent includes, for example, a combination of EFEP and an azo compound, a hydrazide compound, or a tetrazole compound. In addition, the combination includes a combination of ETFE and an azo compound, a hydrazide compound, or a tetrazole compound.

Base Resin

The base resin used in the embodiment of the invention includes not less than one fluorine resins (hereinafter, may be referred to as a high melting point fluorine resin) that have a melting point of being not less than 40 degrees C. higher than the above-mentioned fluorine resin that has a melting point of not more than 230 degrees C.

It is preferable that a tetrafluoroethylene-perfluoroalkyl vinyl ether copolymer (PFA) or a tetrafluoroethylene-hexafluoropropylene copolymer (FEP) is used as the high melting point fluorine resin. PFA and FEP can be used in combination. PEA has a melting point of approximately 300 to 315 degrees C., and FRP has a melting point, of approximately 260 to 270 degrees C.

The high melting point fluorine resin is mixed with the master batch such that the content thereof is preferably 59.9 to 98.9% by mass, more preferably 64.7 to 96.7% by mass, and furthermore preferably 69.5 to 94.5% by mass in the foamed resin molded product. If the content of the high melting point fluorine resin falls within the above-mentioned range, a foamed resin molded product that has good solder dip resistance can be obtained.

Other Components

The master batch or the base resin used in the embodiment of the invention can further include a foam nucleating agent. By this, the bubble diameter generated can be miniaturized. As the foam nucleating agent, a foam nucleating agent that is not decomposed in the molten fluorine resin and has good dispersibility can be used. For example, boron nitride, talc, zeolite, silica, active carbon, silica gel and the like can be preferably used.

The master batch or the base resin used in the embodiment of the invention can further include an antioxidant, a copper inhibitor, a flame retardant, a flame retardant assistant, a colorant, a filler, a light stabilizer, a cross-linker, carbon black and the like that are usually blended to an insulation layer of an insulated wire.

The foamed resin molded product obtained includes the decomposition residue of the chemical foaming agent. It is preferable that the decomposition residue is eliminated, if it is eliminable. The decomposition residue includes, as one example, the following compounds. Namely, the decomposition residue of an azo compound includes cyanuric acid, urazole, and biurea, the residue of a hydrazide compound includes polydithiophenylether, polythiophenylbenzenesulfonylether, the residue of a nitroso compound includes hexamethylenetetramine, and the residue of a hydrazo compound includes urazole.

Characteristics, Shape and Use Application of Foamed Resin Molded Product

In the embodiments of the invention, the foamed resin molded product has air bubbles of which average bubble diameter corresponding to a diameter of a circle is preferably not more than 200 μm. In case of using the foamed resin molded product for an insulator of a small diameter insulated wire, the average bubble diameter corresponding to a diameter of a circle is preferably not more than 100 μm, more preferably 65 μm. In case of using the foamed resin molded product for an insulator of a large diameter insulated wire, the average bubble diameter corresponding to a diameter of a circle is preferably not more than 200 μm, more preferably 160 μm.

In the embodiments of the invention, the foamed resin molded product has an extent of foaming of preferably not less than 30%, more preferably not less than 35% and furthermore preferably not less than 40%.

In the embodiments of the invention, the foamed resin molded product has characteristic impedance of preferably 48 to 52 Ω.

In the preferred embodiments of the invention, the foamed resin molded product is excellent in characteristics such as solder dip resistance, deformation ratio, pull-out force, Voltage Standing Wave Ratio (VSWR) and the like.

The foamed resin molded product according to the embodiment of the invention can be formed to have various shapes, such as a cord shape, a plate shape, a film shape, a pipe shape.

The foamed resin molded product according to the embodiment of the invention can be preferably used for an insulation layer of an insulated wire and a cable. For example, it can be also preferably used for an insulation layer of a differential signal transmission cable that is capable of transmitting at high speed of not less than 10 Gbps level.

Manufacturing Method of Foamed Resin Molded Product

The manufacturing method of a foamed resin molded product according to the embodiment of the invention includes preparing a master batch comprising a fluorine resin that has a melting point of not more than 230 degrees C. and a chemical foaming agent and mixing and foaming the master batch and a base resin comprising not less than one fluorine resins that have a melting point of being not less than 40 degrees C. higher than the fluorine resin that has a melting point of not more than 230 degrees C. by an extrusion molding method.

As a device for preparing the master batch, a single-screw extruder, a double-screw extruder, a kneading mixer, a Banbury (registered trade mark) mixer and the like can be used.

In a process of kneading and foaming by an extrusion molding method, for example, in case of manufacturing a foamed resin molded product as an insulation layer of an insulated wire, the extruder can be a corrosion-resistant extruder. In an extrusion process of a foamed insulated wire, a temperature of the extruder is important, and in case of using FEP for the high melting point fluorine resin, the extruder including a cylinder, a head and a cap, is used at the following temperature. Namely, the cylinder is preferably used at 230 to 320 degrees C., the head is preferably used at approximately 320 degrees C., and the cap is preferably used at approximately 320 degrees C. In addition, in case of using PFA for the high melting point fluorine resin, the extruder is used at the following temperature. Namely, the cylinder is preferably used at 260 to 350 degrees C., the head is preferably used at approximately 350 degrees C., and the cap is preferably used at approximately 340 degrees C.

Configuration of Foamed Insulated Wire and Cable

The foamed insulated wire according to the embodiment of the invention includes the above-mentioned insulation layer comprised of the foamed resin molded product according to the embodiment of the invention. In addition, the cable according to the embodiment of the invention includes the foamed insulated wire according to the embodiment of the invention.

First Embodiment of the Invention

Figure 2:
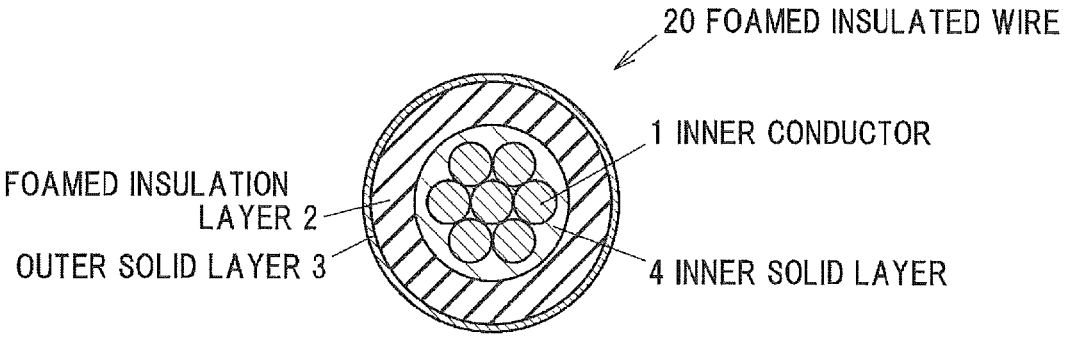
FIG. 2 is a cross-sectional view schematically showing a foamed insulated wire according to a modification of the first embodiment shown in FIG. 1.
Figure 3:
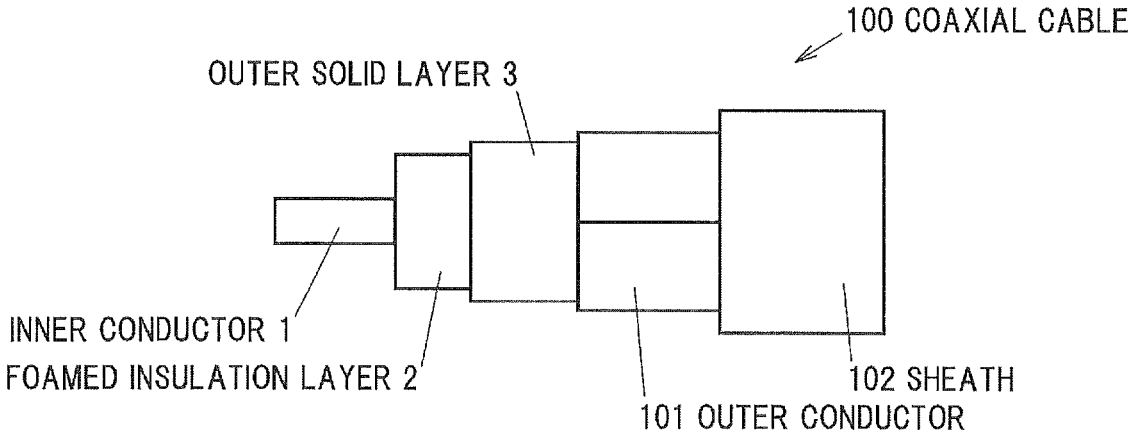
FIG. 3 is a side view schematically showing a coaxial cable in a longitudinal direction according to the first embodiment of the invention.

FIG. 1 is a cross-sectional view schematically showing a foamed insulated wire according to a first embodiment of the invention. FIG. 2 is a cross-sectional view schematically showing a foamed insulated wire according to a modification of the first embodiment shown in FIG. 1. In addition, FIG. 3 is a side view schematically showing a coaxial cable in a longitudinal direction according to the first embodiment of the invention.

The foamed insulated wire 10 is configured to include inner conductors (stranded conductors) 1 and a foamed insulation layer 2 formed to cover the outer periphery of the inner conductors 1, the foamed insulation layer 2 being comprised of the above-mentioned foamed resin molded product according to the embodiment of the invention. As shown in FIG. 1, if necessary, an outer solid layer 3 can be formed on the outer side of the foamed insulation layer 2. In addition, as a foamed insulated wire 20 shown in FIG. 2, if necessary, an inner solid layer 4 can be also formed on the inner side of the foamed insulation layer 2.

As the inner conductor 1, a copper wire and a silvered copper wire can be used. Not only the stranded wire as shown in FIG. 1 but also a single wire can be used.

As materials for the outer solid layer 3 and the inner solid layer 4, for example, FEP, PFA, and ETFE can be used.

The coaxial cable 100 is configured to include the foamed insulated wire 10, an outer conductor 101 formed on the outer solid layer 3 of the foamed insulated wire 10 and a sheath 102 formed to cover the outer periphery of the outer conductor 101.

The outer conductor 101 can be formed by longitudinal winding (so-called cigarette winding) of a copper tape, or an aluminum/nylon laminate tape. Instead of the longitudinal winding, spiral winding can be also used. Other than the above-mentioned tapes, a copper corrugated tube, an aluminum straight tube, an aluminum corrugated tube, a copper wire braid, a tinned copper wire braid, a silvered copper wire braid and the like can be also used.

As materials for the sheath 102, for example, polyvinyl chloride, polyethylene, and flame retardant polyethylene can be used.

FIG. 3 shows the coaxial cable 100 configured such that only one foamed insulated wire 10 is used, but a coaxial cable configured such that a plurality of the foamed insulated wires 10 gathered together are covered by an outer conductor and a sheath can be also used.

Second Embodiment of the Invention

Figure 4:
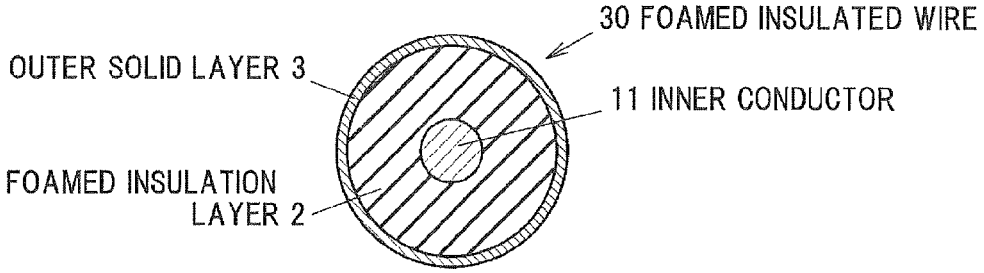
FIG. 4 is a cross-sectional view schematically showing a foamed insulated wire according to a second embodiment of the invention.
Figure 5:
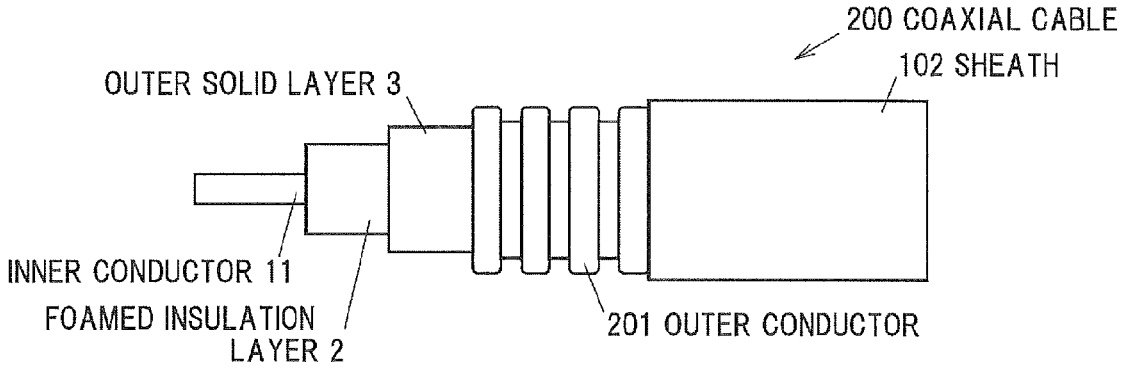
FIG. 5 is a side view schematically showing a coaxial cable in a longitudinal direction according to the second embodiment of the invention.
Figure 6:
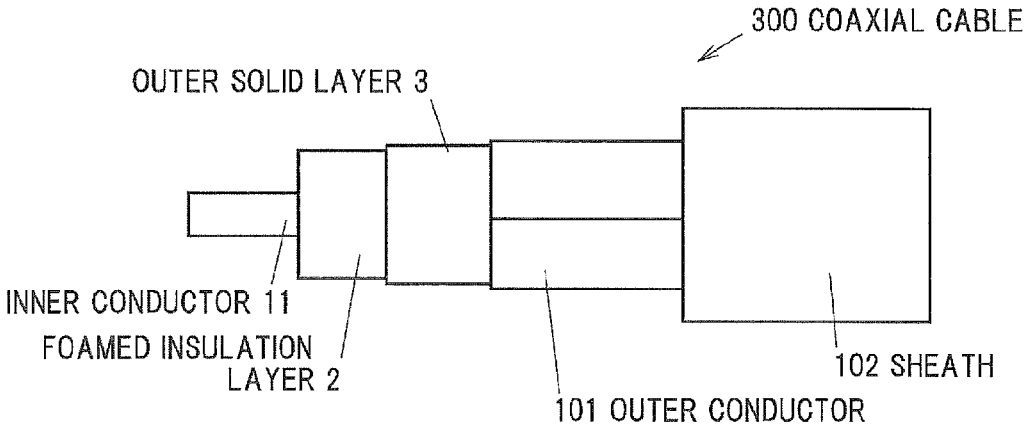
FIG. 6 is a side view schematically showing a coaxial cable in a longitudinal direction according to a modification of the second embodiment shown in FIG. 5.

FIG. 4 is a cross-sectional view schematically showing a foamed insulated wire according to a second embodiment of the invention. FIG. 5 is a side view schematically showing a coaxial cable in a longitudinal direction according to the second embodiment of the invention. In addition, FIG. 6 is a side view schematically showing a coaxial cable in a longitudinal direction according to a modification of the second embodiment shown in FIG. 5.

The foamed insulated wire 30 according to the second embodiment shown in FIG. 4 is different from the foamed insulated wire 10 according to the first embodiment only in terms of using an inner conductor (a single wire) 11 instead of the inner conductor (a stranded wire) 1.

The coaxial cable 200 shown in FIG. 5 is configured to include the foamed insulated wire 30, an outer conductor 201 formed on the outer solid layer 3 of the foamed insulated wire 30 and a sheath 102 formed to cover the outer periphery of the outer conductor 201. FIG. 5 shows the coaxial cable 200 including the outer conductor 201 configured to use a copper corrugated tube, but the coaxial cable 300 shown in FIG. 6 can be also used, the coaxial cable 300 including the outer conductor 101 configured to use a copper tape to which the longitudinal winding is applied, similarly to the first embodiment shown in FIG. 3.

Third Embodiment of the Invention

Figure 7:
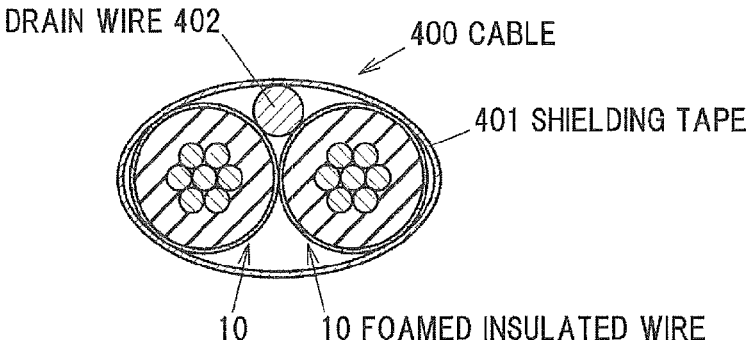
FIG. 7 is a cross-sectional view schematically showing a cable according to a third embodiment of the invention.
Figure 8:
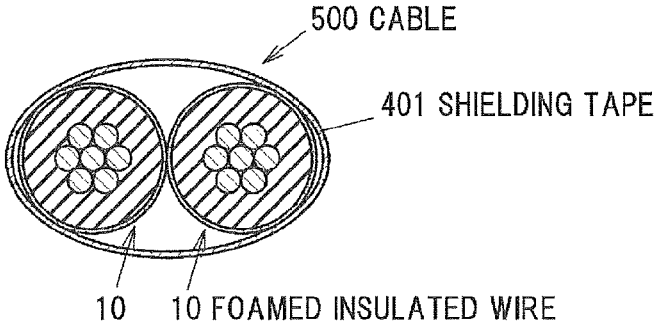
FIG. 8 is a cross-sectional view schematically showing a cable according to a modification of the third embodiment shown in FIG. 7.

FIG. 7 is a cross-sectional view schematically showing a cable according to a third embodiment of the invention. FIG. 8 is a cross-sectional view schematically showing a cable according to a modification of the third embodiment shown in FIG. 7.

The cable 400 shown in FIG. 7 is configured to include two foamed insulated wires 10 arranged in parallel, a drain wire 402 arranged between the foamed insulated wires 10 along the longitudinal direction of the cable 400 and a shielding tape 401 formed to cover the outer peripheries of the foamed insulated wires 10 and the drain wire 402 in a lump.

The cable 500 shown in FIG. 8 is different from the cable 400 in terms of not using the drain wire 402.

As materials for the shielding tape 401, materials generally usable for the cable can be used.

Fourth Embodiment of the Invention

Figure 9:
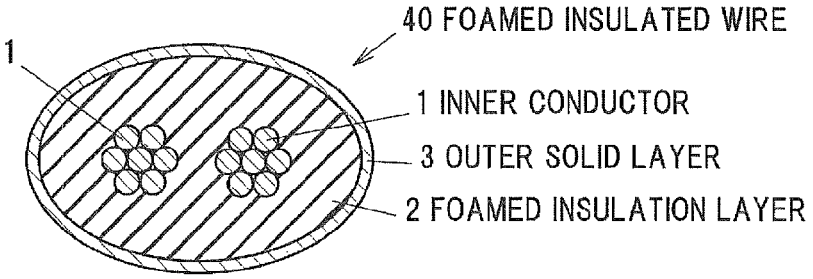
FIG. 9 is a cross-sectional view schematically showing a foamed insulated wire according to a fourth embodiment of the invention.
Figure 10:
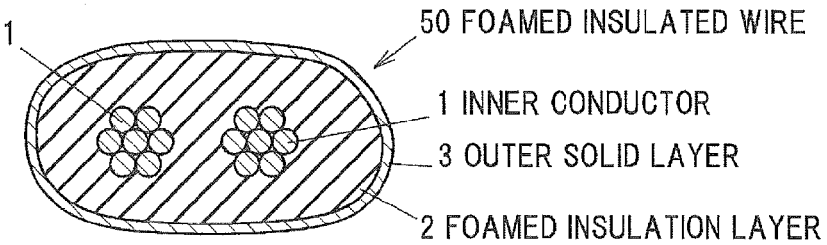
FIG. 10 is a cross-sectional view schematically showing a foamed insulated wire according to a modification of the fourth embodiment shown in FIG. 9.

FIG. 9 is a cross-sectional view schematically showing a foamed insulated wire according to a fourth embodiment of the invention. FIG. 10 is a cross-sectional view schematically showing a foamed insulated wire according to a modification of the fourth embodiment shown in FIG. 9.

The foamed insulated wire 40 according to the fourth embodiment shown in FIG. 9 is different from the foamed insulated wire 10 according to the first embodiment shown in FIG. 1 in terms of being configured to include two inner conductors (stranded wires) 1 arranged in parallel, and a foamed insulation layer 2 formed to cover the outer peripheries of the two inner conductors 1 in a lump, the foamed insulation layer 2 having an elliptical shape elongated in the arrangement direction of the two inner conductors 1 in cross-section.

In addition, the foamed insulated wire 50 shown in FIG. 10 has a flattened elliptical shape having flat parts parallel to the arrangement direction of the two inner conductors 1 in cross-section instead of the elliptical shape in cross-section.

Fifth Embodiment of the Invention

Figure 11:
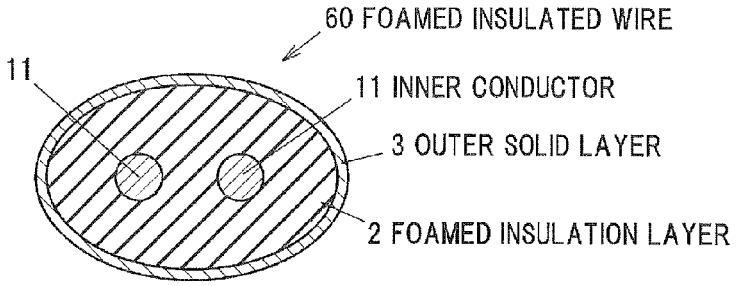
FIG. 11 is a cross-sectional view schematically showing a foamed insulated wire according to a fifth embodiment of the invention.
Figure 12:
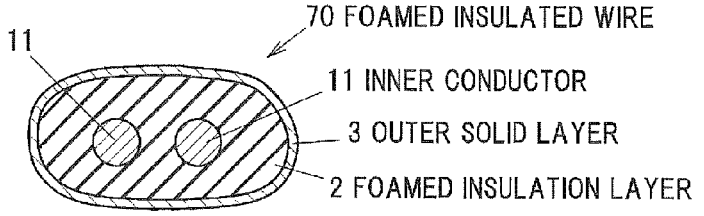
FIG. 12 is a cross-sectional view schematically showing a foamed insulated wire according to a modification of the fifth embodiment shown in FIG. 11.

FIG. 11 is a cross-sectional view schematically showing a foamed insulated wire according to a fifth embodiment of the invention. FIG. 12 is a cross-sectional view schematically showing a foamed insulated wire according to a modification of the fifth embodiment shown in FIG. 11.

The foamed insulated wire 60 according to the fifth embodiment shown in FIG. 11 is different from the foamed insulated wire 30 according to the second embodiment shown in FIG. 4 in terms of being configured to include two inner conductors (single wires) 11 arranged in parallel, and a foamed insulation layer 2 formed to cover the outer peripheries of the two inner conductors 11 in a lump, the foamed insulation layer 2 having an elliptical shape elongated in the arrangement direction of the two inner conductors 11 in cross-section.

In addition, the foamed insulated wire 70 shown in FIG. 12 has a flattened elliptical shape having flat parts parallel to the arrangement direction of the two inner conductors 11 in cross-section instead of the elliptical shape in cross-section.

Manufacturing Method of Foamed Insulated Wire and Cable

The foamed insulated wire and the cable according to the embodiment of the invention can be manufactured by a known manufacturing method of the foamed insulated wire and the cable except for using the foamed resin molded product according to the embodiment of the invention as the foamed insulation layer of the insulated wire. In this case, it is preferable that the extruder used for forming the outer solid layer is used at such a temperature that the cylinder temperature is 230 to 350 degrees C., and the head temperature is approximately 350 degrees C. As the extrusion method, both of a double layer co-extrusion method in which the foamed insulation layer and the outer solid layer are extruded at the same time, and a two layers common extrusion method in which the foamed insulation layer and the outer solid layer are separately extruded can be adopted.

Advantages of the Embodiments

According to the embodiments, a foamed resin molded product manufactured by foaming a fluorine resin such as PFA, FEP having a high melting point by a chemical foaming method, a foamed insulated wire, a cable and a method of manufacturing the foamed resin molded product can be provided. In addition, the following advantages can be provided.

(1) According to the foamed insulated wire and the cable including the insulation layer comprised of the foamed resin molded product according to the embodiment, a small diameter foamed insulated wire and cable can be obtained, that are excellent in characteristics such as characteristic impedance, solder dip resistance, deformation ratio, pull-out force.

(2) According to the foamed insulated wire and the cable including the insulation layer comprised of the foamed resin molded product according to the embodiment, a large diameter foamed insulated wire and cable can be obtained, that are excellent in characteristics such as an amount of attenuation, VSWR, characteristic impedance, solder dip resistance, deformation ratio, pull-out force.

EXAMPLES

Preparation of Master Batch

A master batch including a chemical foaming agent was prepared in accordance with the blending composition described in Table 1. Materials used are as follows.

<Resin>

EFEP: Trade name RP 4020, manufactured by Daikin Industries, Ltd.

ETFE: Trade name EP 610, manufactured by Daikin Industries, Ltd.

High density polyethylene (HDPE): Trade name HI-ZEX5305E ("HI-ZEX" is a registered trade mark), manufactured by Prime Polymer Co., Ltd.

<Chemical Foaming Agent>

Azo compound: azodicarbonamide (ADCA): Trade name VINYFOR AC#3, manufactured by Eiwa Chemical Ind. Co., Ltd.

Hydrazide compound: 4-4'-oxybisbenzenesulfonyl hydrazide (OBSH): Trade name NEOCELLBORN 41000S, manufactured by Eiwa Chemical Ind. Co., Ltd.

Tetrazole compound: bistetrazole diammonium (BHT-$2NH_3$): CELLTETRA, manufactured by Eiwa Chemical Ind. Co., Ltd.

<Foam Nucleating Agent>

Boron nitride: Trade name Boron nitride (BN), Grade name (SP 2), manufactured by DENKI KAGAKU KOGYO KABUSHIKI KAISHA In particular, a chemical foaming agent was added to powders of EFEP or ETFE, and these materials were mixed by using a fast fluidization type mixer (super mixer) manufactured by Kawata Mfg. Co., Ltd. and sold by a trade name of Piccolo SMP-2, at a mixing blade revolving speed of 50 rpm, for 5 minutes. After that, the mixture was kneaded by using a different direction twin-screw extruder having a bore diameter of 20 mm manufactured by Toyo Seiki Seisaku-Sho Ltd. at an extrusion temperature of 150 to 190 degrees C. at a screw revolving speed of 20 rpm, so that master batches were prepared. A part of the master batches was prepared by adding a foam nucleating agent together with the chemical foaming agent.

On the other hand, for Comparative Examples, master batches (MB18 to MB 19) were prepared by using high density polyethylene (HDPE) instead of EFEP or ETFE. In particular, HDPE (90% by mass in MB 18 and 95% by mass in MB 19) and a chemical foaming agent (the above-mentioned tetrazole compound: bistetrazole diammonium (BHT-$2NH_3$)) manufactured by Eiwa Chemical Ind. Co., Ltd. and sold by a trade name of CELLTETRA (10% by mass in MB 18 and 5% by mass in MB 19) were kneaded by using rolls, taken out in the form of sheet and pelletized by a sheet pelletizer. After that, the pellets obtained were kneaded by using a different direction twin-screw extruder having a bore diameter of 20 mm manufactured by Toyo Seiki Seisaku-Sho Ltd. at an extrusion temperature of 160 degrees C. at a screw revolving speed of 20 rpm, so that master batches were prepared.

TABLE 1

| (Unit: % by mass) | | MB 1 | MB 2 | MB 3 | MB 4 | MB 5 | MB 6 | MB 7 | MB 8 | MB 9 | MB 10 | MB 11 | MB 12 | MB 13 | MB 14 | MB 15 | MB 16 | MB 17 |
|---|---|---|---|---|---|---|---|---|---|---|---|---|---|---|---|---|---|---|
| Resin | EFEP (RP4020) | 90 | 90 | 90 | 85 | 85 | 95 | 90 | 90 | 92.5 | 95 | 95 | 90 | 95 | — | — | — | — |
| | ETFE (EP610) | — | — | — | — | — | — | — | — | — | — | — | — | | 90 | 85 | 95 | 90 |
| Chemical foaming agent | Azo compound (ADCA) | — | — | 10 | — | 10 | — | — | 5 | — | 5 | — | 5 | 2.5 | — | — | — | — |
| | Hydrazide compound (OBSH) | — | 10 | — | — | — | — | — | — | — | — | 5 | 5 | 2.5 | — | — | — | — |

TABLE 1-continued

| (Unit: % by mass) | | MB 1 | MB 2 | MB 3 | MB 4 | MB 5 | MB 6 | MB 7 | MB 8 | MB 9 | MB 10 | MB 11 | MB 12 | MB 13 | MB 14 | MB 15 | MB 16 | MB 17 |
|---|---|---|---|---|---|---|---|---|---|---|---|---|---|---|---|---|---|---|
| | Tetrazole compound (BHT-2NH$_3$) | 10 | — | — | 10 | — | 5 | 5 | — | 7.5 | — | — | — | — | 10 | 10 | 5 | 5 |
| Foam nucleating agent | Boron nitride (BN SP2) | — | — | — | 5 | 5 | — | 5 | 5 | — | — | — | — | — | — | 5 | — | 5 |

Manufacturing of Small Diameter Foamed Insulated Wire and Cable

The master batches prepared and a base resin were kneaded and foamed by the extrusion molding in accordance with the blending composition described in Table 2, thereby the inner conductor was covered with the foamed insulation layer, so that the small diameter foamed insulated wire and cable as Examples were manufactured, The base resins used are as follows.

<Base Resin>

FEP: Trade name NP 21, manufactured by Daikin Industries, Ltd.

PFA: Trade name AP 210, manufactured by Daikin Industries, Ltd.

Figure 13:
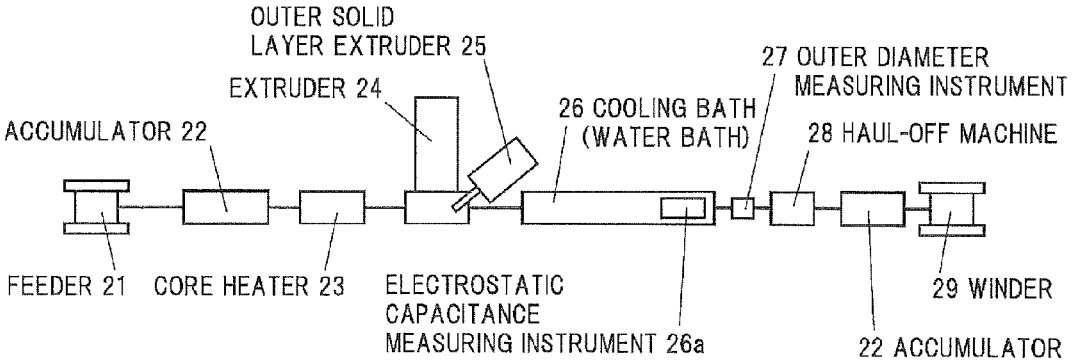
FIG. 13 is an explanatory view schematically showing a manufacturing line configured to manufacture a small diameter foamed insulated wire in Examples.

FIG. 13 is an explanatory view schematically showing a manufacturing line configured to manufacture a small diameter foamed insulated wire in Examples. In particular, the manufacturing line is configured to send an inner conductor forward by a feeder 21, and allow it to pass through a core heater 23 by using two accumulators 22 installed in the manufacturing line, and then form a foamed insulation layer to cover the outer periphery of the inner conductor by an extruder 24, and simultaneously form an outer solid layer to cover the outer periphery of the foamed insulation layer by an outer solid layer extruder 25 (a double layer co-extrusion method).

As the inner conductor, a stranded wire (copper wire) having a diameter of 7/0.127 ϕmm was used. In addition, as a material of the outer solid layer, FEP (sold by a Trade name NP 101, manufactured by Daikin Industries, Ltd.) was used. The foamed insulation layer was formed to have a diameter within the range of 1.0±0.04 ϕmm. The foamed insulation layer was also formed to have an extent of foaming within the range of 60±5%, and a characteristic impedance within the range of 50±2Ω.

In case of the extrusion using FEP, the extrusion was carried out at the temperature condition of the extruder 24 that the cylinder temperature is 230 to 320 degrees C., the head temperature is 320 degrees C. and the cap temperature is 320 degrees C. In addition, in case of the extrusion using PFA, the extrusion was carried out at the temperature condition that the cylinder temperature is 260 to 350 degrees C., the head temperature is 350 degrees C. and the cap temperature is 340 degrees C. The outer solid layer extruder 25 was used at the temperature condition that the cylinder temperature is 230 to 320 degrees C., and the head temperature is 320 degrees C. As the extruder 24, a 40 mm extruder was used, and as the outer solid layer extruder 25, a 28 mm extruder was used. In both of the extruders, the screw ratio (L/D) of 25 was adopted, and as the screw, a full flighted screw was used. In addition, the extruder 24 was used at the screw revolving speed of 20 rpm, and the outer solid layer extruder 25 was used at the screw revolving speed of 8 rpm.

In addition, the manufacturing line is configured to allow the inner conductor covered with the outer solid layer to pass through a cooling bath (water bath) 26, and wind it by a winder 29 via a haul-off machine 28 so as to manufacture a foamed insulated wire of 1000 m in length.

Furthermore, the manufacturing line is configured to shield the foamed insulated wire manufactured by applying an aluminum/polyester laminated film thereto by longitudinal winding, and then form a sheath of polyvinyl chloride on the outer periphery thereof by an extrusion molding method so as to manufacture a small diameter high speed transmission cable.

Evaluation of Small Diameter Foamed Insulated Wire and Cable

The judgment whether the foamed insulation layer is good or bad at the manufacturing time of the foamed insulated wire was judged from the outer diameter and electrostatic capacitance (C) that are in-line measurements at the extrusion, and the extent of foaming calculated from the outer diameter and electrostatic capacitance. The measurement methods are as explained below, and the measurement result is shown in Table 2.

The outer diameter of the foamed insulation layer was measured by using an in-line measuring instrument (a double screw laser outer diameter measuring instrument 27 manufactured by Takikawa engineering Co., Ltd.) in the extruder.

The electrostatic capacitance of the foamed insulation layer was measured by using an in-line measuring instrument (an electrostatic capacitance measuring instrument **26*a*** manufactured by BETA.

The extent of foaming of the foamed insulation layer was calculated and stored from an in-line data of a personal computer (PC) that controls the extruder. Both of the outer diameter and the electrostatic capacitance were recorded by a data logger and the average value of the cable of 1000 m in length manufactured was obtained.

In addition, the measurement of the average bubble diameter was carried out by cutting the cable of 1000 in by 100 m, and then taking cross-sectional photographs at 50-fold magnification by an electronic microscope, and then measuring the bubble diameter corresponding to a diameter of a circle in each of the cross-sections by using an image processing software sold by a trade name of winROOF manufactured by Mitani Corporation. The measurement result is shown in Table 2.

It is necessary that the foamed insulation layer has an average bubble diameter of not more than 100 μm. This is because in case of the insulation layer having a thin thickness as the small diameter foamed insulated wire according to the embodiment, if variation of the bubble diameter is increased, an outer diameter variation is caused, and as a result, variation of the characteristic impedance is increased.

The judgment whether the cable manufactured is acceptable or unacceptable was judged from the result of the measurement of characteristic impedance (50±2Ω), solder dip resistance, deformation ratio, pull-out force of the foamed insulated wire. The measurement methods are as explained below, and the measurement result is shown in Table 2.

The characteristic impedance was measured by using the small diameter foamed insulated wire obtained and an impedance analyzer sold by a trade name of E4991A manufactured by Agilent Technologies according to TDR method. The foamed insulated wire having characteristic impedance within the range of 50±2Ω, was judged as acceptable.

Figures 15A, 15B, 15C:
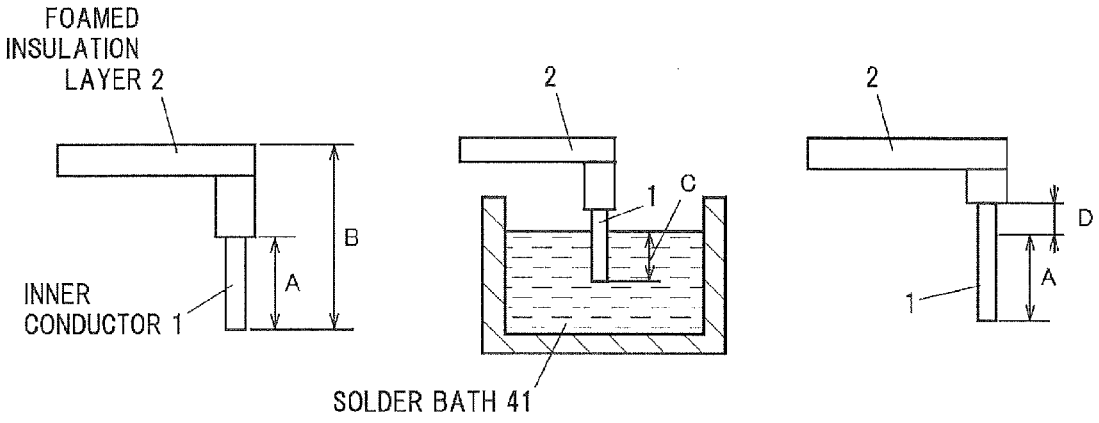
FIGS. 15A to 15C are explanatory views schematically showing a measurement method of solder dip resistance of the foamed insulated wire.

FIGS. 15A to 15C are explanatory views schematically showing a measurement method of solder dip resistance of the foamed insulated wire. A part of the foamed insulation layer 2 corresponding to the length from the front edge of the foamed insulated wire to the point of 12.7 mm from the front edged, shown as length A in FIG. 15A, was peeled, so as to expose the inner conductor 1. After that, the foamed insulated wire was bent at a right angle from the point of 25.4 mm from the front edge, shown as length B in FIG. 15A, so as to prepare five samples. A part of the exposed inner conductor 1 of the above-mentioned sample corresponding to the length from the front edge of the inner conductor 1 to the point of 10 mm from the front edged, shown as length C in FIG. 15B, was immersed for 10 seconds in a solder bath 41 that was preliminarily heated to 270 degrees C. It was pulled out after 10 seconds, the shrinkage length of the foamed insulation layer 2, shown as length D in FIG. 15C, was measured. With regard to solder dip resistance, the foamed insulated wire including the foamed insulation layer 2 of which shrinkage length falls within the range of not more than 5 mm was judged as acceptable.

Figure 16A:
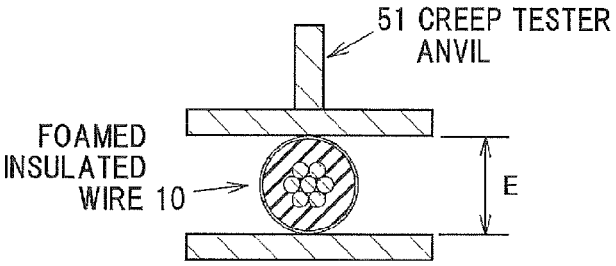
FIGS. 16A to 16B are explanatory views schematically showing a measurement method of deformation ratio of the foamed insulated wire.
Figure 16B:
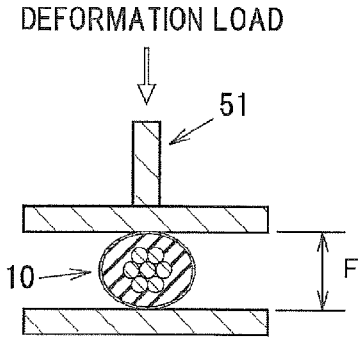

FIGS. 16A to 16B are explanatory views schematically showing a measurement method of deformation ratio of the foamed insulated wire. By using a heating creep tester (a creep tester anvil (a pressing jig) 51, and applying deformation load of 5N to the foamed insulated wire 10, deformation amount was measured, and deformation ratio was obtained from the formula described below. The foamed insulated wire 10 having deformation ratio that falls within the range of not more than 20% was judged as acceptable.

$$\text{Deformation ratio (\%)}=[(E-F)/(E-X)]\times 100$$

E: initial diameter of foamed insulated wire (shown as length E in FIG. 16A)

F: diameter after deformation of foamed insulated wire (shown as length F in FIG. 16A)

X: diameter of inner conductor

Figure 17A:
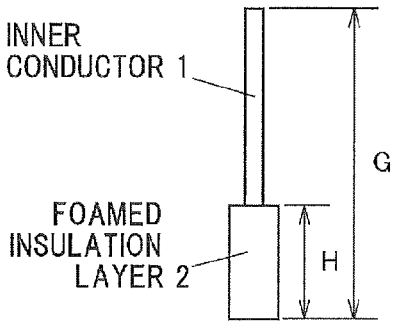
FIGS. 17A to 17B are explanatory views schematically showing a measurement method of pull-out force of the foamed insulated wire.
Figure 17B:
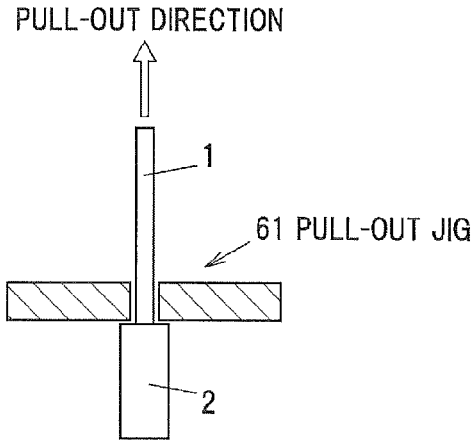

FIGS. 17A to 17B are explanatory views schematically showing a measurement method of pull-out force of the foamed insulated wire. The foamed insulated wire 10 was cut so as to have a length of 100 mm, shown as length G in FIG. 17A, and the inner conductor 1 was exposed such that the foamed insulation layer having a length of 25 mm was left, shown as length H in FIG. 17A, and the inner conductor 1 exposed was passed through a hole formed in an iron plate, the hole having a diameter of the diameter of the inner conductor plus 0.2 mm so as to set it in a tensile tester (a pull-out jig 61), and a pull-out load at the time of pulling-out at a speed of 200 mm/min was measured, so as to determine the maximum value as the pull-out force. The foamed insulated wire 10 having pull-out force that falls within the range of not less than 10 N was judged as acceptable.

TABLE 2

| (Unit: % by mass) | | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 |
|---|---|---|---|---|---|---|---|---|---|---|---|---|---|---|
| Base resin | FEP (NP21) | 90 | 90 | 60 | 60 | — | — | 90 | 90 | 90 | 90 | — | 90 | 90 |
| | PFA (AP210) | — | — | — | — | 90 | 90 | — | — | — | — | 90 | — | — |
| MB resin | EFEP (RP4020) | 9 | 8.5 | 38 | 37 | 9 | 8.5 | 9 | 9 | 9 | 8.5 | 9 | — | — |
| | ETFE (EP610) | — | — | — | — | — | — | — | — | — | — | — | 9 | 8.5 |
| Chemical foaming agent | Azo compound (ADCA) | — | — | — | — | — | — | 1 | — | 0.5 | 1 | 1 | — | — |
| | Hydrazide compound (OBSH) | — | — | — | — | — | — | — | 1 | 0.5 | — | — | — | — |
| | Tetrazole compound (BHT-2$NH_3$) | 1 | 1 | 2 | 3 | 1 | 1 | — | — | — | — | — | 1 | 1 |
| Foam nucleating agent | Boron nitride (BN SP2) | — | 0.5 | — | — | — | 0.5 | — | — | — | 0.5 | — | — | 0.5 |
| Number of used master batch | | MB 1 | MB 4 | MB 6 | MB 9 | MB 1 | MB 4 | MB 3 | MB 2 | MB 12 | MB 5 | MB 3 | MB 14 | MB 15 |
| Characteristics Acceptability criterions in < > | Outer diameter (ϕ mm) of insulation layer <1.00 ± 0.04> | 0.99 | 1.02 | 1.01 | 1.01 | 1.01 | 0.99 | 0.98 | 0.99 | 1.02 | 1.01 | 1.02 | 1 | 1.01 |
| | Extent of foaming of insulation layer (%) | 57 | 56.2 | 64 | 64.7 | 56.3 | 57.7 | 57.2 | 61.1 | 58 | 59 | 57.5 | 55.7 | 55.7 |
| | Average bubble diameter (ϕ μm) corresponding to diameter of circle | 70 | 55 | 85 | 98 | 75 | 60 | 60 | 90 | 80 | 50 | 80 | 97 | 80 |
| | Characteristic impedance (Ω) <50 ± 2> | 49.5 | 49.3 | 51.2 | 51.7 | 50.3 | 49.6 | 49.2 | 49.6 | 50.7 | 50.3 | 50.7 | 49.1 | 49.2 |
| | Solder dip resistance (260° C. × 10 sec) <shrinkage ≤ 5 mm> | 2 | 2 | 4.8 | 4.8 | 1.2 | 1.2 | 2 | 2 | 2 | 2 | 2 | 1.5 | 1.5 |
| | Deformation ratio (5N × 10 min) <≤20%> | 13.5 | 11.7 | 19.8 | 19.8 | 10.5 | 9.5 | 12 | 18.5 | 12.7 | 10 | 17.5 | 18.8 | 18.7 |
| | Pull-out force (25 mm) <≥10N> | 15 | 15 | 11 | 11 | 14.5 | 16 | 15 | 12 | 15 | 15 | 16 | 12.5 | 12.5 |

Ex. 1 to Ex. 13: Example 1 to Example 13

Examples 1 to 4 in Table 2 are corresponding to a case that FEP was used as the base resin, EFEP was used as the resin material of the master batch, and bistetrazole diammonium of a tetrazole compound was used as the chemical foaming agent.

Example 1 is corresponding to a case that MB 1 was used as the master batch. The characteristic impedance was 49.5Ω included in an acceptable range. In addition, all of the solder dip resistance, deformation ratio, and pull-out force were included in an acceptable range.

Example 2 is corresponding to a case that MB 4 was used as the master batch. By an effect of the foam nucleating agent, the bubble diameter was small as 55 μm, and the characteristic impedance was 49.3Ω included in an acceptable range, in addition, all of the solder dip resistance, deformation ratio, and pull-out force were included in an acceptable range.

Example 3 is corresponding to a case that MB 6 was used as the master batch. An additive amount of the chemical foaming agent was increased as 2.0% by mass so as to increase an amount of the decomposed gas, thus the extent of foaming was heightened as 64%. The characteristic impedance was 51.2Ω included in an acceptable range. In addition, all of the solder dip resistance, deformation ratio, and pull-out force were included in an acceptable range.

Example 4 is corresponding to a case that MB 9 was used as the master batch. An additive amount of the chemical foaming agent was further increased as 3.0% by mass so as to further increase an amount of the decomposed gas, thus the extent of foaming was further heightened as 64.7%. The characteristic impedance was 51.7Ω included in an acceptable range. In addition, all of the solder dip resistance, deformation ratio, and pull-out force were included in an acceptable range.

Examples 5 and 6 in Table 2 are corresponding to a case that PFA was used as the base resin.

Example 5 is corresponding to a case that MB 1 was used as the master batch. The characteristic impedance was 50.3 Ωincluded in an acceptable range, in addition, all of the solder dip resistance, deformation ratio, and pull-out force were included in an acceptable range.

Example 6 is corresponding to a case that MB 4 was used as the master batch. By adding of the foam nucleating agent, the bubble diameter was decreased. The characteristic impedance was included in an acceptable range. In addition, all of the solder dip resistance, deformation ratio, and pull-out force were included in an acceptable range.

Examples 7 to 10 in Table 2 are corresponding to a case that FEP was used as the base resin and an azo compound and/or a hydrazide compound were used as the chemical foaming agent.

Example 7 is corresponding to a case that MB 3 was used as the master batch. Since ADCA has also an effect as a nucleating agent, the bubble diameter was small, and the characteristic impedance was 49.2Ω included in an acceptable range. In addition, all of the solder dip resistance, deformation ratio, and pull-out force were included in an acceptable range.

Example 8 is corresponding to a case that MB 2 was used as the master batch. In comparison with a case that the other chemical foaming agents were used, there was a tendency to increase the bubble diameter. However, the characteristic impedance was 49.6Ω included in an acceptable range. Since the bubble diameter was increased, the deformation ratio was increased as 18.5%, but was included in an acceptable range. In addition, all of the solder dip resistance, and pull-out force were included in an acceptable range.

Example 9 is corresponding to a case that MB 12 was used as the master batch. By a nucleating agent effect of ADCA, the bubble diameter was decreased. The characteristic impedance was 50.7Ω included in an acceptable range. In addition, all of the solder dip resistance, deformation ratio, and pull-out force were included in an acceptable range without problem.

Example 10 is corresponding to a case that MB 5 was used as the master batch. By an effect of the foam nucleating agent, the bubble diameter was extremely decreased as 50 μm, and the characteristic impedance was 50.3Ω included in an acceptable range. In addition, all of the solder dip resistance, deformation ratio, and pull-out force were included in an acceptable range.

Example 11 in Table 2 are corresponding to a case that PFA was used as the base resin and MB 3 was used as the master batch. The bubble diameter was slightly increased, but the characteristic impedance was 50.7Ω included in an acceptable range. In addition, since the bubble diameter was increased, the deformation ratio was increased as 17.5%, but was included in an acceptable range. In addition, all of the solder dip resistance, and pull-out force were included in an acceptable range.

Examples 12 and 13 in Table 2 are corresponding to a case that ETFE was used as the master batch. Since ETFE has a melting point of 230 degrees C., a tetrazole compound having a decomposition temperature of approximately 290 degrees C. was used as the chemical foaming agent used for the master batch.

Example 12 is corresponding to a case that MB 14 was used as the master batch. By an effect of the foam nucleating agent, the bubble diameter was extremely decreased as 50 μm, and the characteristic impedance was 50.3Ω included in an acceptable range. In addition, all of the solder dip resistance, deformation ratio, and pull-out force were included in an acceptable range. In comparison with EFEP, ETFE is inferior in compatibility with FEP and PFA. Consequently, there is a tendency that dispersion of the foaming agent becomes insufficient. As a result, the bubble diameter is increased. However, the characteristic impedance was 49.1Ω included in an acceptable range. On the other hand, since ETFE having a melting point higher than EFEP was used, the solder dip resistance was slightly enhanced. However, the deformation ratio was increased according to increase of the bubble diameter, but all of the deformation ratio and pull-out force were included in an acceptable range.

Example 13 is corresponding to a case that MB 15 was used as the master batch. In addition, Example 13 is corresponding to a system that in addition to the chemical foaming agent, BN of the foam nucleating agent was used, and by an effect of the foam nucleating agent, the bubble diameter was slightly decreased. The characteristic impedance was 49.2Ω included in an acceptable range, and with regard to the other characteristics, the deformation ratio was slightly increased, but all of the solder dip resistance, deformation ratio and pull-out force were included in an acceptable range.

Comparative Examples of Small Diameter Foamed Insulated Wire and Cable

Comparative Example 1 is corresponding to a case that a fluorine resin having a melting point of not more than 230 degrees C. is not used and only FEP (sold by a Trade name NP 21) was used as the fluorine resin, and bistetrazole diammonium (BHT-2$NH_3$) of a tetrazole compound sold by a trade name of CELLTETRA and manufactured by Eiwa Chemical Ind. Co., Ltd was used as the chemical foaming agent. When FEP and BHT-2$NH_3$ of the chemical foaming agent were kneaded at the mass ratio of 99:1, the chemical foaming agent was decomposed, thus the foaming extrusion molding could not be carried out.

Comparative Example 2 was configured to cover the inner conductor with the foamed insulation layer by kneading and foaming according to an extrusion molding such that the blending ratio of HDPE and BHT-2$NH_3$ in the final form is determined as "HDPE:BHT-2$NH_3$=99:1" at the mass ratio by using the master batch (M 18) and the base resin prepared for Comparative Examples, and to manufacture small diameter foamed insulated wires and cables as Comparative Examples as well as Examples. As the base resin, HDPE was used, that is identical with a resin used for preparing the master batch (M 18). The characteristic impedance was included in an acceptable range, but HDPE has a low melting point of 135 degrees C., consequently with regard to solder dip resistance, the foamed insulated wire including the foamed insulation layer of which shrinkage length was extremely increased as 10 mm was judged as unacceptable.

Comparative Example 3 is an example of the physical foaming method configured to mix FEP (99.5% by mass) with boron nitride of the foam nucleating agent (0.5% by mass), and use nitrogen gas having an input pressure of 45 MPa as the foaming agent. Comparative Example 3 was carried out by a full compound method. The bubble diameter could not be controlled, so as to be increased as 150 μm. As a result, the characteristic impedance was included in an acceptable range, but the deformation ratio was increased as 25% and the pull-out force was decreased as 7N, so as to be unacceptable.

Comparative Examples 4 to 6 are examples of the physical foaming method configured to mix an engineering plastic as the base resin (99.5% by mass) with boron nitride of the foam nucleating agent (0.5% by mass), and use nitrogen gas having an input pressure of 42 to 46 MPa (43 MPa in Comparative Example 4, 46 MPa in Comparative Example 5, and 42 MPa in Comparative Example 6) as the foaming agent. Comparative Examples 4 to 6 were carried out by a full compound method. All of the resins used have a high melting point, but were increased in dielectric constant after foaming as 2.2 to 2.4. Consequently, the characteristic impedance was unacceptable.

The engineering plastics used are as follows.

Comparative Example 4: Polyamidenylon sold by a trade name of Maranyl A125J manufactured by Unitika Ltd.

Comparative Example 5: Polyether ether ketone sold by a trade name of 381G manufactured by Vitrex Comparative Example 6: polyethylene terephthalate sold by a trade name of Toraycon 1401-X06 manufactured by Toray Industries Inc.

Manufacturing of Large Diameter Foamed Insulated Wire and Cable

Next, the master batches prepared and the base resin were kneaded and foamed by the extrusion molding in accordance with the blending composition described in Table 3, thereby the inner conductor was covered with the foamed insulation layer, so that the large diameter foamed insulated wire and cable as Examples were manufactured, The base resins used are identical to the resins used for the small diameter foamed insulated wire and cable.

Figure 14:
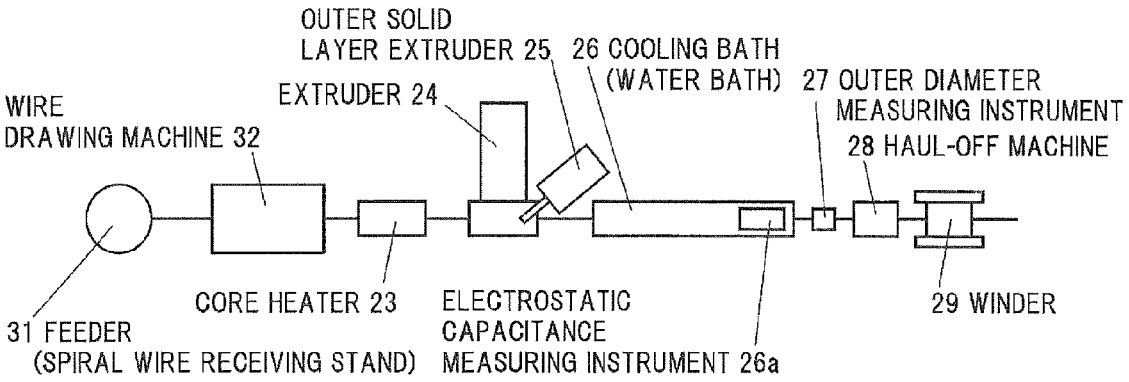
FIG. 14 is an explanatory view schematically showing a manufacturing line configured to manufacture a large diameter foamed insulated wire in Examples.

FIG. 14 is an explanatory view schematically showing a manufacturing line configured to manufacture a large diameter foamed insulated wire in Examples. In particular, the manufacturing line is configured to send an inner conductor forward by a feeder (spiral wire receiving stand) 31, and allow it to pass through a wire drawing machine 32 and a core heater 23 by using two accumulators 22 installed in the manufacturing line, and then form a foamed insulation layer to cover the outer periphery of the inner conductor by an extruder 24, and simultaneously form the outer solid layer to cover the outer periphery of the foamed insulation layer by an outer solid layer extruder 25 (a double layer co-extrusion method).

As the inner conductor, a single wire (copper wire) having a diameter of 0.96 ϕmm was used. The foamed insulation layer was formed to have a diameter within the range of 2.65±0.1 ϕmm. The foamed insulation layer was also formed to have an extent of foaming within the range of 45±2%, and a characteristic impedance within the range of 50±1Ω.

In case of the extrusion using FEP, the extrusion was carried out at the temperature condition of the extruder 24 that the cylinder temperature is 230 to 320 degrees C., the head temperature is 320 degrees C. and the cap temperature is 320 degrees C. In addition, in case of the extrusion using PFA, the extrusion was carried out at the temperature condition that the cylinder temperature is 260 to 350 degrees C., the head temperature is 350 degrees C. and the cap temperature is 340 degrees C. The outer solid layer extruder 25 was used at the temperature condition that the cylinder temperature is 230 to 320 degrees C., and the head temperature is 320 degrees C. As the extruder 24, a 50 mm extruder was used, and as the outer solid layer extruder 25, a 28 mm extruder was used. In both of the extruders, the screw ratio (L/D) of 25 was adopted, and as the screw, a full flighted screw was used. In addition, the extruder 24 was used at the screw revolving speed of 25 rpm, and the outer solid layer extruder 25 was used at the screw revolving speed of 12 rpm.

In addition, the manufacturing line is configured to allow the inner conductor covered with the outer solid layer to pass through a cooling bath (water bath) 26, and wind it by a winder 29 via a haul-off machine 28 so as to manufacture a foamed insulated wire of 1000 m in length.

The foamed insulated wire manufactured was covered with a copper tape in a corrugated shape so as to form the outer conductor, and furthermore, the manufacturing line is configured to form a sheath of polyethylene on the outer periphery thereof by an extrusion molding method so as to manufacture a large diameter 3D coaxial cable of 100 m in length.

Evaluation of Large Diameter Foamed Insulated Wire and Cable

Similarly to the case of the small diameter foamed insulated wire, the judgment whether the foamed insulation layer is good or bad at the manufacturing time of the foamed insulated wire was judged from the outer diameter and electrostatic capacitance (C) that are in-line measurements at the extrusion, and the extent of foaming calculated from the outer diameter and electrostatic capacitance. The measurement methods are as explained above, and the measurement result is shown in Table 3.

In addition, the measurement of the average bubble diameter was carried out by cutting the cable of 100 m by 10 m, and using an image processing software similarly to the case of the small diameter foamed insulated wire.

If variation of the bubble diameter is increased, an outer diameter variation is caused, and as a result, variation of the characteristic impedance is increased as more than 1Ω, so as to be unacceptable. In order to keep it not more than 1Ω, it is necessary that the average bubble diameter is not more than 200 μm.

The judgment whether the cable manufactured is acceptable or unacceptable was judged from the result of the measurement of characteristic impedance (50±1Ω), solder dip resistance, deformation ratio, pull-out force, an amount of attenuation and Voltage Standing Wave Ratio (VSWR) of the foamed insulated wire. In particular, it is criteria for the judgment whether the cable manufactured is acceptable or unacceptable that the characteristic impedance, amount of attenuation and Voltage Standing Wave Ratio (VSWR) satisfy the standards.

The measurement methods of the characteristic impedance (50±1Ω), solder dip resistance, deformation ratio, and pull-out force are as explained above. However, the measurement of the characteristic impedance was carried out, in case of the small diameter foamed insulated wire, by TDR method, and in case of the large diameter foamed insulated wire, by Smith chart method, and if it was included in the range of 50±1Ω, it was determined as acceptable. In addition, the thickness of the insulation layer is larger than the small diameter insulated wire, thus in a deformation ratio test, the load was set to 20 N. The measurement result is shown in Table 3.

Figure 18:
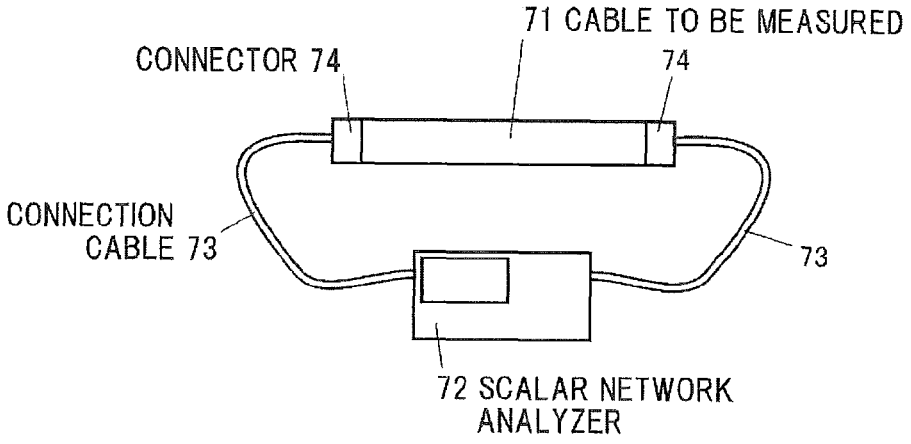
FIG. 18 is an explanatory views schematically showing a measurement method of an amount of attenuation of the foamed coaxial cable.

FIG. 18 is an explanatory views schematically showing a measurement method of an amount of attenuation of the foamed coaxial cable. The measurement of the amount of attenuation was carried out by using a scalar network analyzer 72 sold by a trade name of 8753ES manufactured by Agilent Technologies. The scalar network analyzer 72 is connected to both ends of a cable to be measured 71 via connection cables 73 and connectors 74. If the amount of attenuation of 2 GHz is included in the range of not more than 48.9 dB/100 m, it was determined as acceptable.

Figure 19:
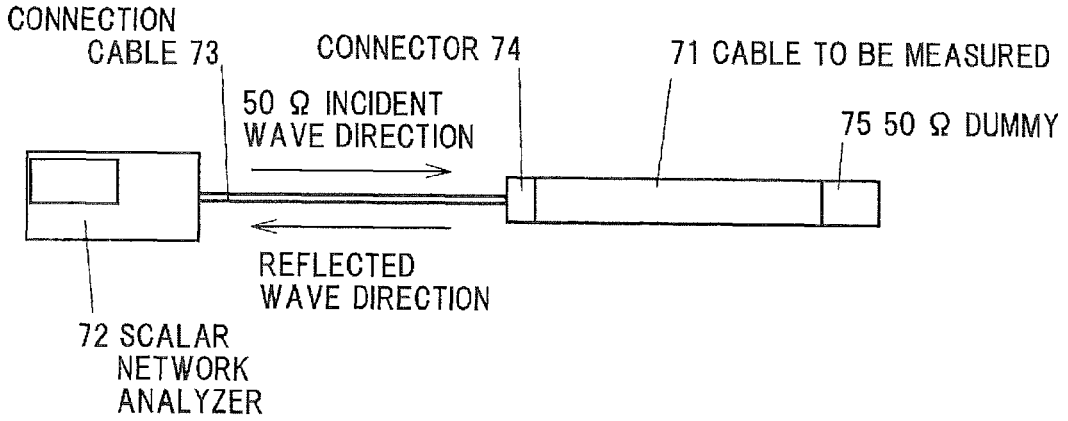
FIG. 19 is an explanatory views schematically showing a measurement method of Voltage Standing Wave Ratio (VSWR) of the foamed coaxial cable.

FIG. 19 is an explanatory views schematically showing a measurement method of Voltage Standing Wave Ratio (VSWR) of the foamed coaxial cable. The measurement of the VSWR that provides a benchmark of stability in the longitudinal direction of the cable was carried out by using the same analyzer as that used in the measurement of the amount of attenuation (a scalar network analyzer 72). The scalar network analyzer 72 was connected to one end of the cable to be measured 71 via the connection cables 73 and the connectors 74, and a resistor (a 50Ω dummy 75) was connected to another end of the cable to be measured 71. From the terminal to which the scalar network analyzer 72 was connected, a signal of 50Ω was entered, and a ratio of the signal reflected was measured. If there is a variation in the bubble and the like included in the cable to be measured 71, a reflected wave (a standing wave) occurs. As a result, the VSWR becomes larger than 1. The nearer to 1 the VSWR is, the more stable the cable is, if the VSWR is included in the range of not more than 1.1 that is the standard, it was determined as acceptable.

TABLE 3

| (Unit: % by mass) | | Ex. 14 | Ex. 15 | Ex. 16 | Ex. 17 | Ex. 18 | Ex. 19 | Ex. 20 | Ex. 21 | Ex. 22 | Ex. 23 | Ex. 24 | Ex. 25 | Ex. 26 |
|---|---|---|---|---|---|---|---|---|---|---|---|---|---|---|
| Base resin | FEP (NP21) | 90 | 90 | — | — | 90 | 90 | 90 | 90 | — | 90 | 90 | — | — |
| | PFA (AP210) | — | — | 90 | 90 | — | — | — | — | 90 | — | — | 90 | 90 |
| MB resin | EFEP (RP4020) | 9.5 | 9 | 9.5 | 9 | 9.5 | 9.5 | 9.5 | 9 | 9.5 | — | — | — | — |
| | ETFE (EP610) | — | — | — | — | — | — | — | — | — | 9.5 | 9 | 9.5 | 9 |
| Chemical foaming agent | Azo compound (ADCA) | — | — | — | — | 0.5 | — | 0.25 | 0.5 | 0.5 | — | — | — | — |
| | Hydrazide compound (OBSH) | — | — | — | — | — | 0.5 | 0.25 | — | — | — | — | — | — |
| | Tetrazole compound (BHT-2$NH_3$) | 0.5 | 0.5 | 0.5 | 0.5 | — | — | — | — | — | 0.5 | 0.5 | 0.5 | 0.5 |
| Foam nucleating agent | Boron nitride (BN SP2) | — | 0.5 | — | 0.5 | — | — | — | 0.5 | — | — | 0.5 | — | 0.5 |
| Number of used master batch | | MB 6 | MB 7 | MB 6 | MB 7 | MB 10 | MB 11 | MB 13 | MB 8 | MB 10 | MB 16 | MB 17 | MB 16 | MB 17 |
| Characteristics Acceptability criterions in < > | Outer diameter (ϕ mm) of insulation layer <2.65 ± 0.1> | 2.65 | 2.67 | 2.62 | 2.68 | 2.65 | 2.67 | 2.7 | 2.68 | 2.65 | 2.7 | 2.75 | 2.73 | 2.73 |
| | Extent of foaming of insulation layer (%) | 45.3 | 44 | 46 | 43.5 | 45.5 | 43 | 43.2 | 43.5 | 45.5 | 43.5 | 43.2 | 43.1 | 43.1 |
| | Average bubble diameter (ϕ μm) corresponding to diameter of circle | 130 | 100 | 140 | 110 | 125 | 160 | 128 | 95 | 145 | 195 | 150 | 192 | 150 |
| | Amount of attenuation (2 GHz) (dB/100 m) <≤48.9> | 48.4 | 48.4 | 48.4 | 48.3 | 48.4 | 48.7 | 48.4 | 48.3 | 48.4 | 48.8 | 48.8 | 48.8 | 48.6 |
| | Voltage Standing Wave Ratio (VSWR) <≤1.1> | 1.05 | 1.03 | 1.05 | 1.03 | 1.05 | 1.08 | 1.04 | 1.03 | 1.05 | 1.08 | 1.09 | 1.09 | 1.07 |
| | Characteristic impedance (Ω) <50 ± 1> | 49.9 | 50.3 | 49.8 | 50.2 | 49.5 | 49.6 | 50.2 | 50.3 | 50.3 | 50.1 | 50.4 | 50.3 | 50.2 |
| | Solder dip resistance (260° C. × 10 sec) <shrinkage ≤5 mm> | 1.5 | 1.5 | 1.6 | 1.6 | 1.8 | 3 | 1.5 | 1.4 | 1.5 | 1.3 | 1.3 | 1.3 | 1.3 |
| | Deformation ratio (5N × 10 min) <≤20%> | 13 | 12 | 13.2 | 11.2 | 13 | 17 | 13 | 11.1 | 11.5 | 18.5 | 15 | 18 | 15 |
| | Pull-out force (25 mm) <≥10N> | 13 | 12.5 | 13 | 15 | 12 | 11 | 13 | 13 | 13 | 11.5 | 12.5 | 11.3 | 13 |

Ex. 14 to Ex. 26: Example 14 to Example 26

Examples 14 to 26 shown in Table 3 are Examples at the time when the large diameter 3D coaxial cables were manufactured. In case of the 3D coaxial cables, the desired extent of foaming is 45%, thus the additive amount of the chemical foaming agent was set to 0.5% by mass.

Examples 14 and 15 are corresponding to a case that FEP was used as the base resin, a tetrazole compound was used as the chemical foaming agent, and EFEP was used as the resin material of the master batch.

Example 14 is corresponding to a case that MB 6 was used as the master batch. The bubble diameter was decreased, and all of the VSWR, amount of attenuation, and characteristic impedance were included in the range of acceptable. In addition, similarly, all of the solder dip resistance, deformation ratio and pull-out force were included in the range of acceptable.

Example 15 is corresponding to a case that MB 7 was used as the master batch. By an effect of the foam nucleating agent, the bubble diameter was further decreased. As a result, variation of the outer diameter was small, the extent of foaming was stable, and all of the VSWR, amount of attenuation, and characteristic impedance were included in the range of acceptable. In addition, similarly, all of the solder dip resistance, deformation ratio and pull-out force were included in the range of acceptable.

Examples 16 and 17 are corresponding to a case that PFA was used as the base resin.

Example 16 is corresponding to a case that MB 6 was used as the master batch. Both of the outer diameter and the extent of foaming were stable, and all of the VSWR, amount of attenuation, and characteristic impedance were included in the range of acceptable, in addition, similarly, all of the solder dip resistance, deformation ratio and pull-out force were included in the range of acceptable.

Example 17 is corresponding to a case that MB 7 was used as the master batch. The bubble diameter was further decreased, and all of the VSWR, amount of attenuation, and characteristic impedance were included in the range of acceptable, in addition, similarly, all of the solder dip resistance, deformation ratio and pull-out force were included in the range of acceptable.

Examples 18 and 22 are corresponding to a case that an azo compound and a hydrazide compound were used as the foaming agent instead of a tetrazole compound.

Example 18 is corresponding to a case that MB 10 was used as the master batch. The bubble diameter was decreased, and all of the VSWR, amount of attenuation, and characteristic impedance were included in the range of acceptable, in addition, similarly, all of the solder dip resistance, deformation ratio and pull-out force were included in the range of acceptable.

Example 19 is corresponding to a case that MB 11 was used as the master batch. The bubble diameter was increased in comparison with the case that the other chemical foaming agent was used, but all of the VSWR, amount of attenuation, characteristic impedance, solder dip resistance, deformation ratio and pull-out force were included in the range of acceptable.

Example 20 is corresponding to a case that MB 13 was used as the master batch. ADCA and OBSH were used in combination as the chemical foaming agent, thus by an effect of ADCA as a nucleating agent, the bubble diameter was decreased. Consequently, all of the VSWR, amount of attenuation, characteristic impedance, solder dip resistance, deformation ratio and pull-out force were included in the range of acceptable.

Example 21 is corresponding to a case that MB 8 was used as the master batch. By an effect of a foam nucleating agent, the bubble diameter was decreased as 95 μm. Consequently, all of the VSWR, amount of attenuation, and characteristic impedance were included in the range of acceptable, in addition, similarly, all of the solder dip resistance, deformation ratio and pull-out force were included in the range of acceptable.

Example 22 is corresponding to a case that MB 10 was used as the master batch. All of the VSWR, amount of attenuation, and characteristic impedance were included in the range of acceptable. In addition, similarly, all of the solder dip resistance, deformation ratio and pull-out force were included in the range of acceptable.

Examples 23 and 26 are corresponding to a case that ETFE was used as the resin material of the master batch. ETFE has a melting point of 230 degrees C., thus a tetrazole compound that has a decomposition temperature of approximately 290 degrees C. was used as the chemical foaming agent used for the master batch.

Example 23 is corresponding to a case that MB 16 was used as the master batch. Compatibility between ETFE and FEP is not good, thus the foaming agent cannot be dispersed into FEP, and variation of the bubble diameter after foaming was increased, but all of the VSWR, amount of attenuation, and characteristic impedance were included in the range of acceptable. In addition, there was no problem in the solder dip resistance, but since the bubble diameter is increased, the deformation ratio was increased, but it was included in the range of acceptable.

Example 24 is corresponding to a case that MB 17 was used as the master batch, and BN of the foam nucleating agent was used in combination. By an effect of the nucleating agent, the bubble diameter was decreased, as a result, all of the VSWR, amount of attenuation, and characteristic impedance were included in the range of acceptable, in addition, similarly, all of the solder dip resistance, deformation ratio and pull-out force were included in the range of acceptable.

Example 25 is corresponding to a case that MB 16 was used as the master batch. Compatibility between PFA and FTFE is not good, thus the foaming agent was not dispersed sufficiently. Consequently, the bubble diameter was increased as 192 μm. However, all of the VSWR, amount of attenuation, and characteristic impedance were included in the range of acceptable. In addition, since the bubble diameter is increased, the deformation ratio was increased as 18%, but it was included in the range of acceptable.

Example 26 is corresponding to a case that MB 17 was used as the master batch. By an effect of the foam nucleating agent, the bubble diameter was decreased, and all of the VSWR, amount of attenuation, and characteristic impedance were included in the range of acceptable, in addition, similarly, all of the solder dip resistance, deformation ratio and pull-out force were included in the range of acceptable.

Comparative Examples of Large Diameter Foamed Insulated Wire and Cable

Comparative Example 7 was configured to cover the inner conductor with the foamed insulation layer by kneading and foaming according to an extrusion molding such that the blending ratio of HDPE and BHT-2$NH_3$ in the final form is determined as "HDPE:BHT-2$NH_3$=99.5:0.5" at the mass ratio by using the master batch (M 19) and the base resin prepared for Comparative Examples, and to manufacture large diameter foamed insulated wires and cables as Comparative Examples as well as Examples. As the base resin, HDPE was used, that is identical with a resin used for preparing the master batch (M 19). Since HDPE has a low melting point of 135 degrees C., the solder dip resistance was judged as unacceptable.

Comparative Example 8 is an example of the physical foaming method configured to mix PEP (99.5% by mass) with boron nitride of the foam nucleating agent (0.5% by mass), and use nitrogen gas having an input pressure of 38 MPa as the foaming agent. Comparative Example 8 was carried out by a full compound method. The bubble diameter could not be controlled, so as to be increased as 250 μm. As a result, the deformation ratio and pull-out force were judged as unacceptable.

Comparative Examples 9 to 11 are examples of the physical foaming method configured to mix an engineering plastic as the base resin (99.5% by mass) with boron nitride of the foam nucleating agent (0.5% by mass), and use nitrogen gas having an input pressure of 34 to 37 MPa (34 MPa in Comparative Example 9, 35 MPa in Comparative Example 10, and 37 MPa in Comparative Example 11) as the foaming agent. Comparative Examples 9 to 11 were carried out by a full compound method. All of the resins used were increased in dielectric constant after foaming as 2.5 to 2.7. Consequently, the VSWR, amount of attenuation, and characteristic impedance of electric characteristics were judged as unacceptable. The engineering plastics used are as follows.

Comparative Example 9: Polyamidenylon sold by a trade name of Maranyl A125J manufactured by Unitika Ltd.

Comparative Example 10: Polyether ether ketone sold by a trade name of 381G manufactured by Vitrex Comparative Example 11: polyethylene terephthalate sold by a trade name of Toraycon 1401-X06 manufactured by Toray Industries Inc.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A foamed resin molded product, comprising:

not less than two fluorine resins that have a different melting point from each other, wherein one of the not less than two fluorine resins comprises a fluorine resin that has a melting point of not more than 230 degrees C., wherein an other of the not less than two fluorine resins comprises a fluorine resin that has a melting point of not less than 40 degrees C. higher than the fluorine resin having the melting point of not more than 230 degrees C., and wherein the foamed resin molded product is obtained by mixing and foaming a master batch comprising the fluorine resin that has the melting point of not more than 230 degrees C. and a chemical foaming agent, and a base resin comprising at least the fluorine resin that has the melting point of being not less than 40 degrees C. higher than the fluorine resin having the melting point of not more than 230 degrees C. by an extrusion molding method, wherein the fluorine resin having the melting point of not more than 230 degrees C. comprises an ethylene-tetrafluoroethylene-hexafluoropropylene copolymer (EFEP), and wherein the fluorine resin having the melting point of not less than 40 degrees C. higher than the fluorine resin having the melting point of not more than 230 degrees C. comprises a tetrafluoroethylene-perfluoroalkyl vinyl ether copolymer (PFA) or a tetrafluoroethylene-hexafluoropropylene copolymer (FEP).

2. The foamed resin molded product according to claim 1, wherein the chemical foaming agent comprises at least one organic chemical foaming agent selected from an azo compound, a hydrazide compound, a nitroso compound, a semicarbazide compound, a hydrazo compound, a tetrazole compound, a triazine compound, an ester compound, a hydrazone compound, and a diazinon compound.

3. The foamed resin molded product according to claim 2, wherein the hydrazide compound comprises 4-4'-oxybisbenzenesulfonyl hydrazide (OBSH).

4. The foamed resin molded product according to claim 2, wherein the tetrazole compound comprises bistetrazole diammonium (BHT-2$NH_3$).

5. The foamed resin molded product according to claim 1, wherein the master batch comprises a foam nucleating agent.

6. The foamed resin molded product according to claim 1, wherein the fluorine resin having the melting point of not more than 230 degrees C. is included 1% to 40% by mass.

7. The foamed resin molded product according to claim 1, wherein the master batch comprises the chemical foaming agent of 0.1% to 3% by mass relative to a total amount of the foamed resin molded product.

8. The foamed resin molded product according to claim 1, wherein the foamed resin includes air bubbles of which average bubble diameter corresponding to a diameter of a circle is not more than 200 μm.

9. The foamed resin molded product according to claim 1, wherein the fluorine resin having the melting point of not more than 230 degrees C. comprises a fluorine resin having a melting point lower than a temperature of decomposition of the chemical foaming agent contained in the master batch.

10. The foamed resin molded product according to claim 1, wherein an amount of modified ethylene in the EFEP is 20% to 55%.

11. A foamed insulated wire, comprising:

an insulation layer comprising the foamed resin molded product according to claim 1.

12. A cable, comprising:

the foamed insulated wire according to claim 11.

13. The foamed insulated wire according to claim 11, wherein a deformation ratio of the foamed insulated wire is not more than 20%, and wherein the deformation ratio is measured by using a heating creep tester, applying deformation load of 5N to the foamed insulated wire, measuring a deformation amount of the foamed insulated wire after 10 minutes, and obtaining the deformation ratio from formula described below:

$$\text{the deformation ratio (\%)}=[(E-F)/(E-X)]\times 100$$

E: an initial diameter of the foamed insulated wire

F: a diameter after deformation of the foamed insulated wire

X: a diameter of an inner conductor of the foamed insulated wire.

14. The foamed insulated wire according to claim 11, wherein a maximum pull-out force of the foamed insulated wire is not less than 10 N, and wherein the pull-out force of the foamed insulated wire is cut to have a length of 100 mm, and an inner conductor of the foamed insulated wire is exposed such that the insulation layer having a length of 25 mm is left, and the inner conductor exposed is passed through a hole formed in an iron plate, the hole having a diameter of the diameter of the inner conductor plus 0.2 mm, so as to be set in a tensile tester, and a pull-out load at the time of pulling-out at a speed of 200 mm/min is measured.

15. The foamed insulated wire according to claim 11, wherein a characteristic impedance of the foamed insulated wire is within a range of 50±2Ω, and wherein the characteristic impedance is measured by using a small diameter foamed insulated wire obtained and an impedance analyzer sold by a trade name of E4991A manufactured by Agilent Technologies according to a Time Domain Reflectometry (TDR) method.

16. The foamed insulated wire according to claim 11, wherein the foamed insulated wire has a solder dip resistance and the insulation layer has a shrinkage length within a range of not more than 5 mm, and wherein the shrinkage length of the insulation layer is measured by peeling a part of the insulation layer corresponding to a length from a front edge of the foamed insulated wire to a point of 12.7 mm from the front edge, so as to expose an inner conductor, bending the foamed insulated wire at a right angle from a point of 25.4 mm from the front edge, so as to prepare a sample, immersing a part of the exposed inner conductor of the sample corresponding to the length from the front edge of the inner conductor to the point of 10 mm from the front edge for 10 seconds in a solder bath preliminarily heated to 270 degrees C., and pulling out the sample after 10 seconds.

17. A method of manufacturing a foamed resin molded product, the method comprising:

preparing a master batch comprising a fluorine resin that has a melting point of not more than 230 degrees C. and a chemical foaming agent; and mixing and foaming the master batch and a base resin comprising at least one fluorine resin that has a melting point of not less than 40 degrees C. higher than the fluorine resin having the melting point of not more than 230 degrees C. by an extrusion molding method, wherein the fluorine resin having the melting point of not more than 230 degrees C. comprises an ethylene-tetrafluoroethylene-hexafluoropropylene copolymer (EFEP), and wherein the at least one fluorine resin having the melting point of not less than 40 degrees C. higher than the fluorine resin having the melting point of not more than 230 degrees C. comprises a tetrafluoroethylene-perfluoroalkyl vinyl ether copolymer (PFA) or a tetrafluoroethylene-hexafluoropropylene copolymer (FEP).

18. The method according to claim 17, wherein the foamed resin molded product comprises not less than two fluorine resins that have a different melting point from each other, wherein one of the not less than two fluorine resins comprises the fluorine resin that has the melting point of not more than 230 degrees C., and wherein an other of the not less than two fluorine resins comprises a fluorine resin that has a melting point of not less than 40 degrees C. higher than the fluorine resin having the melting point of not more than 230 degrees C.

* * * * *